United States Patent [19]

Laub, III

[11] 4,300,603

[45] Nov. 17, 1981

[54] ANTIDRIP VOLUMETRIC RAPID FILLING MACHINE USABLE WITH VERY VISCOUS SUBSTANCES

[76] Inventor: Herman Laub, III, 244 N. San Marino, San Gabriel, Calif. 91775

[21] Appl. No.: 139,256

[22] Filed: Apr. 11, 1980

[51] Int. Cl.[3] ..... B65B 3/12

[52] U.S. Cl. ..... 141/258; 141/303; 222/71; 222/309

[58] Field of Search ..... 141/1-12, 141/37, 39-68, 99, 392, 129-192, 250-289, 302, 303; 222/71, 309

[56] References Cited

U.S. PATENT DOCUMENTS 3,605,827 9/1971 Risser ..... 141/46

*Primary Examiner*—Houston S. Bell, Jr.

*Attorney, Agent, or Firm*—Peter I. Lippman

[57] ABSTRACT

This device for rapid and extremely accurate filling of containers includes a duct for bleeding off gas bubbles from a metering device, where prior bubble-eliminating provisions are inadequate due to extreme product viscosity. The device also has relative adjustment between a positive mechanical stop, used to define very precisely the substance volume metered by a biacting piston, and a control switch used to reverse the piston. This adjustability corrects an inaccuracy arising in prior devices due to the necessarily slower speed of the piston with extremely viscous product.

12 Claims, 3 Drawing Figures

Fig. 2.
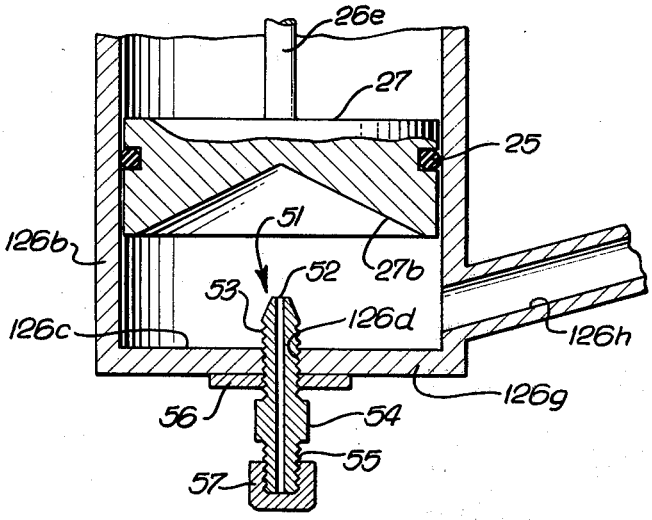
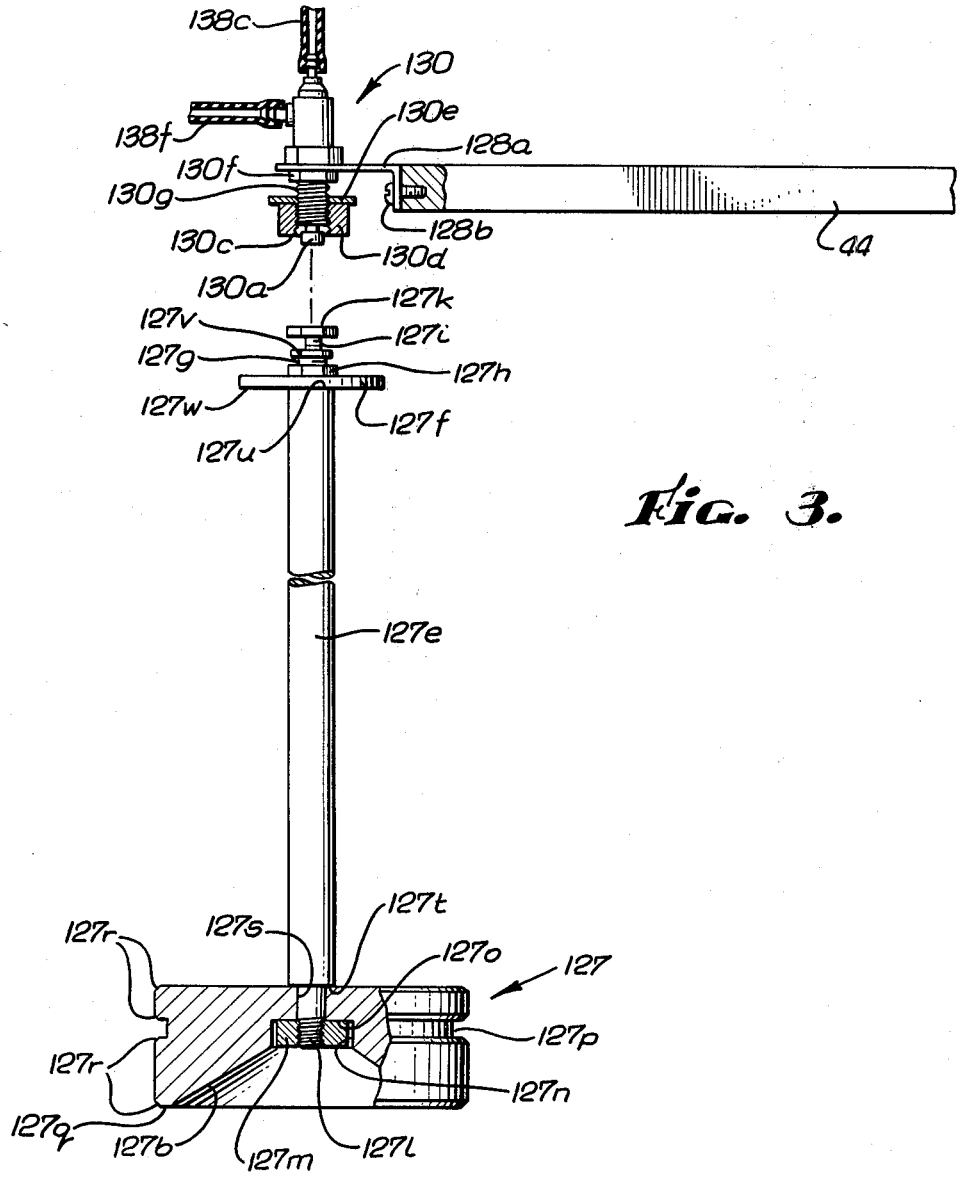
Fig. 3.

ANTIDRIP VOLUMETRIC RAPID FILLING MACHINE USABLE WITH VERY VISCOUS SUBSTANCES

BACKGROUND OF THE INVENTION

1. FIELD

This invention relates to the provision of automatic machinery for the filling of containers, such as bottles, with flowable substances ranging from very thin to extremely viscous, and including substances which readily form suds or foam.

In particular my invention is directed to overcoming problems in the prior art peculiar to the dispensing of extremely viscous substances.

2. PRIOR ART

The closest prior art of which I am aware is disclosed in my United States Pat. Nos. 3,870,089, which issued Mar. 11, 1975; and 4,095,628, issued June 20, 1978.

Nearly all the principles and features disclosed in those two patents are operative in the system of my present invention, with only two exceptions—both arising from the peculiarities of extremely viscous products. As noted in those prior patents, the principles and features there disclosed are directed to dispensing products ranging from quite thin to quite viscous. The products which are the motivation for the present invention, by contrast, are outside that range—being "extremely" viscous.

As explained in my U.S. Pat. No. 3,870,089, very accurate volumetric filling requires a cyclically operating volumetric metering device, close control of liquid at all points in the system downstream of the metering device, and close control of air or other gas which is or might be in the system. In addition, as also explained in that patent, very accurate filling requires close monitoring of system operation to guard against partial fills, very clean operation, and finally, for a multiple-head filling machine, operation of all the heads under as nearly as possible identical conditions.

These principles are implemented by the following techniques, which are general background for the present invention: (1) a submersible dispensing nozzle which fills deep within the bottle, and which has (2) a closure device at its tip and (3) a device for sucking up drops of the fluid from the nozzle—but only when the tip is out of the body of the fluid; (4) positive-pressurized operation of the entire system at all times, (5) isolation of the product-dispensing ducts and chambers from any pneumatic control system, (6) positioning the nozzle above the volumetric chamber, (7) a bubble-entrapment device upstream of the volumetric chamber; (8) sensors and interlocks to monitor and control system cycling; and (9) individual flow-rate adjustment for each head, and (10) common volume adjustment for all the heads.

Four other devices for implementing the principles enumerated above are particularly pertinent to the improvements of the present invention: (1) a biacting piston, (2) solid, positive mechanical stops for defining the ends of the piston travel within the volumetric chamber, (3)individual volume adjustment for each head, and (4) complementarily formed adjacent end-walls of the chamber and piston, at the bottom of the chamber and piston respectively, which act cooperatively to squeeze gas bubbles toward a port of the chamber so as to eliminate them from the system within the first few cycles of operation. These four features, like those mentioned in the preceding paragraph, were described in my U.S. Pat. No. 3,870,089. The principles which give rise to these four devices are just as important with extremely viscous products as with others, and the first three of the four remain useful, with modifications, in implementing the principles.

Referring to FIG. 2 of my U.S. Pat. No. 3,870,089, note that positive mechanical stopping action at the bottom of the piston stroke is provided by engagement of the lower surface 27*b* of the piston 27 with the lower internal surface 26*c* of the chamber 26; and the positive mechanical stopping action at the top of the piston stroke is provided by engagement of the actuator 27*f*, carried by piston rod 27*e*, with the pneumatic switch button 30*a*. In the latter case, the positive mechanical stopping action does not actually occur until the button "bottoms out" (or, as drawn, "tops out") against the inner end of the cavity provided for the button action in the switch body 30.

Pneumatic control signals for reversal of the piston 27 at the bottom of its stroke are generated by engagement of the actuator 27*f* with the button 29*a* of pneumatic switch 29; and such signals are generated at the top of the stroke by engagement of the actuator 27*f* with the previously mentioned switch button 30*a*. Both limit switches 29 and 30 are adjustable with respect to the cylinder 26.

Since lower limit switch 29 performs solely the reversing function while lower positive stop action is provided by the chamber end-wall 26*c*, the point at which the reversing signal occurs is inherently adjustable with respect to the point at which the positive mechanical stop is engaged. By contrast, since the upper limit switch 30 performs both the reversing function and the positive mechanical stop function, the reversing signal is not adjustable with respect to the mechanical stop. The fact of this nonadjustability becomes crucial in relation to extremely viscous products, as will be explained below.

Other prior-art systems generally lack the basic context of the present invention, namely the combination of automatically reversing dispensing systems with biacting pistons and positive stops. For example, the system of Buford et al., disclosed in U.S. Pat. No. 3,447,281, issued June 3, 1969, discloses a biacting piston and limit switches for reversing the piston; however, the switches themselves are not positioned to halt the piston. Overtravel of the piston with respect to the switches is intended, as may be seen from the drawings, and reliance is placed entirely on the reversing signals, with no provision for operative positive mechanical stops. One of the points in Buford's specification where this fact appears is at column 11, lines 48 through 57, where it is stated, "When the piston reaches the right end of its travel, the enlargement 49 at the left end of the piston rod opens valve 204 to . . . admit a pneumatic signal . . . to . . . halt the filling operation . . . . "

As to the bubble-expulsion technique mentioned above, the prior art other than my U.S. Pat. No. 3,870,089 does not appear to address itself to any comparable matter, since the prior art generally is not concerned with precision levels at which expulsion of bubbles is significant.

My U.S. Pat. No. 4,095,628 points out two additional principles and their implementations, improving on my earlier system:

(1) A five-port, four-way valve used to control product flow in two different paths simultaneously, thereby reversing the flow connections to the biacting volumetric cylinder, can be simplified to a four-port valve by using an internal passageway formed within the valve spool.

(2) Foaming products are best dispensed with a variable-speed system—high flowrate for filling the parts of each container where foaming is least problematical, and lower flowrate for filling the parts of the container where foaming is most serious.

(The second principle is implemented by a timed constriction of the flow path between the product supply and the dispensing nozzle. In some cases the constriction is carried by the volumetric piston itself, on a spring which projects in front of the piston, and so is brought into operation only when the piston is within a particular distance of the end of its stroke.)

The simplified valve remains useful with extremely viscous materials. The principle and implementation of the two-speed system are independent of the extreme-viscosity case, and can be used either separately from or in conjunction with the extreme-viscosity provisions of the present invention. It may be noted, however, that relatively few products are both foaming and extremely viscous; and, moreover, that extremely viscous products move through the dispensing system so slowly that foaming tendencies tend to be suppressed without use of slower speeds at critical points in the fill.

My U.S. Pat. No. 4,095,628 is not addressed to the matter of bubble expulsion, but rather to foaming control speed variation. However, it is significant to note the speed-variation device illustrated in FIG. 2 of that patent is not readily compatible with the bubble-squeezing structure in FIG. 2 of my earlier patent. Therefore it is necessary to choose, in practicing my heretofore disclosed inventions, between foaming control through speed variation and bubble removal. My present invention provides bubble removal in a manner which is at least in principle compatible with speed variation as shown in FIG. 2 of my U.S. Pat. No. 4,095,628.

In attempting to design, make and use the systems of my U.S. Pat. Nos. 3,870,089 and 4,095,628 with extremely viscous substances to be dispensed, I have noted small imprecisions of initially unexplained origin.

Although the imprecisions involved were rather small, it is important to bear in mind the context of systems of this type. Under the law, packaging companies must fill each container with at least as much fluid as is nominally contained—i.e., as the label indicates. Therefore, whatever imprecision is present in a dispensing system must all be "placed," so to speak, above the nominal value; that is to say, the packager, not the consumer, must absorb the economic impact of any imprecision. Of course the requirement that every customer receive at least a nominal fill is properly founded in the concern for consumer protection; while the objectionability of significant overfill, in some industries, is compounded by the undesirability of waste per se—from an ecological or natural-resources conservation point of view.

Hence the importance of maintaining, with extremely viscous products as well as with less-viscous ones, the precision level indicated in my first-mentioned patent—1/28 ounce, or roughly five drops, per gallon, or 0.03%.

BRIEF SUMMARY OF THE INVENTION

My present invention provides a dispensing system similar to those of my two earlier patents discussed above, but with certain improvements directed to use of the system to dispense extremely viscous products.

In searching for the source of small imprecisions mentioned above, I discovered that there were actually two such sources contributing significantly to the imprecisions.

First, the bubble-expulsion device of my earlier patent did not operate to completely expel bubbles formed in extremely viscous substances. The viscosity and surface tension of the materials simply overcame the tendency for gas bubbles to flow out the lower port. This factor may have been emphasized by the lower piston speed necessarily produced by the flow of more-viscous materials through the various tubulations, ports and valves of the system. (As to the antifoaming feature of my U.S. Pat. No. 4,095,628, of course there was no provision for bubble expulsion at all.)

Captive gas bubbles in the space below the piston have a variable and erratic effect on the accuracy of fill—depending on system pressure and temperature, product batch, and the arrival of more gas to increase the size of the bubble or partial removal of the bubble through the port. As between successive fills from a particular chamber the effect may, merely for example, be opposite—that is, a slightly high fill into one container followed by a slightly low fill in the adjacent container.

Second, the reduced piston velocity produced by viscous flow through the system in effect desynchronized the stopping and reversing actions of the upper limit switch. This occurred because the functional pneumatic signal connection is made in a typical commercial pneumatic switch (as with a typical commercial electrical switch) before the button or other actuated element reaches the end of its mechanical travel. In FIG. 2 of either of my earlier patents, for example, the button 30*a* completes the pneumatic connection from pneumatic line 38*c* to pneumatic line 38*f* before the button 30*a* fully "bottoms out" into the recess in the switch body 30.

This phenomenon is either desirable or indifferent with respect to fluids of low or ordinary viscosity: where the piston is traveling quickly, if the pneumatic reversing signal is slightly early the piston reaches the mechanical stop before the reversing control valve (14 in my earlier patents) has time to shift the connections to the volumetric chamber. In this way the early signal is simply harmless. Even if the signal is early enough to start the reversing valve shifting action, the effect (so long as the shifting does not actually proceed to the halfway point) is merely to decrease the cross-sectional area of the flow paths for product through the reversing valve—slowing the piston down slightly so that it "bottoms out" the upper limit switch button 30*a* in its recess in switch body 30 with slightly less force, thereby extending the life of the apparatus.

With products which are viscous in the extreme, however, the piston travels much more slowly to begin with, and the early generation of the reversing signal has a very significant effect. First, as the reversing valve 14 begins to shift, the driving force on the piston 27 decreases; because of the lower initial speed there is less momentum in the moving piston and fluid. With these two factors operative, the piston slows down relatively quickly. This in turn gives the reversing valve 14 more time in which to complete its shifting action. When the valve approaches the halfway point in that action, flow is stopped entirely by the lands 15*k*, 15*d* blocking ports 11*e* and 11*n*, respectively; and the piston 27 too stops. If at this point the button 30*a* has not yet "bottomed out" within switch body 30, it never will—for the reversing valve 14 now begins to open the conduits with reversed connections, causing the piston to move downward without first reaching the positive mechanical stop at the top of the stroke.

This sequence of events of course results in a slightly short fill—the amount of discrepancy varying with system pressure, temperature, batch of product, lubrication of the seals at the piston and reversing-valve seal, pneumatic control-system pressure, stiction of the spool in the reversing valve, and so forth.

The problem cannot be corrected without modifying the equipment, since, as noted previously, the upper-limit reversing signal is not adjustable with respect to the upper-limit mechanical stop.

Following my discovery of the imprecision, and its two sources, of volumetric fill with extremely viscous products, I completed my present invention by providing relative adjustment of the upper positive stop—i.e., the stop which is adjustable with respect to the chamber—relative to the trigger point of the upper reversing switch; and by providing a concavity in the bottom surface of the piston for deliberate trapping of gas bubbles and a duct through the bottom wall of the volumetric chamber for bleeding gas bubbles from the top of the concavity.

Fullest realization of the advantages of the instant invention requires bringing into action the principles introduced in the present disclosure, as well as most of those disclosed in my earlier patents and enumerated above. As these principles are functionally combined in concert the resulting incremental capability, with the addition of each principle, becomes qualitatively different. It is of course possible to omit some of these principles and suffer the loss of this qualitative difference in capability only under extraordinary conditions—such as certain kinds of system malfunction. Some of the features therefore are regardable as secondary, and their omission from a particular device shall not diminish the applicability to such device of those of the appended claims which do not recite such secondary features.

The foregoing discussion will be more fully understood through the following description of preferred embodiments, with reference to the accompanying drawings—of which:

BRIEF DESCRIPTION OF THE DRAWINGS

FIG. 2 is a similar view of an alternate version of one part of the embodiment shown in FIG. 1.

Figure 1:
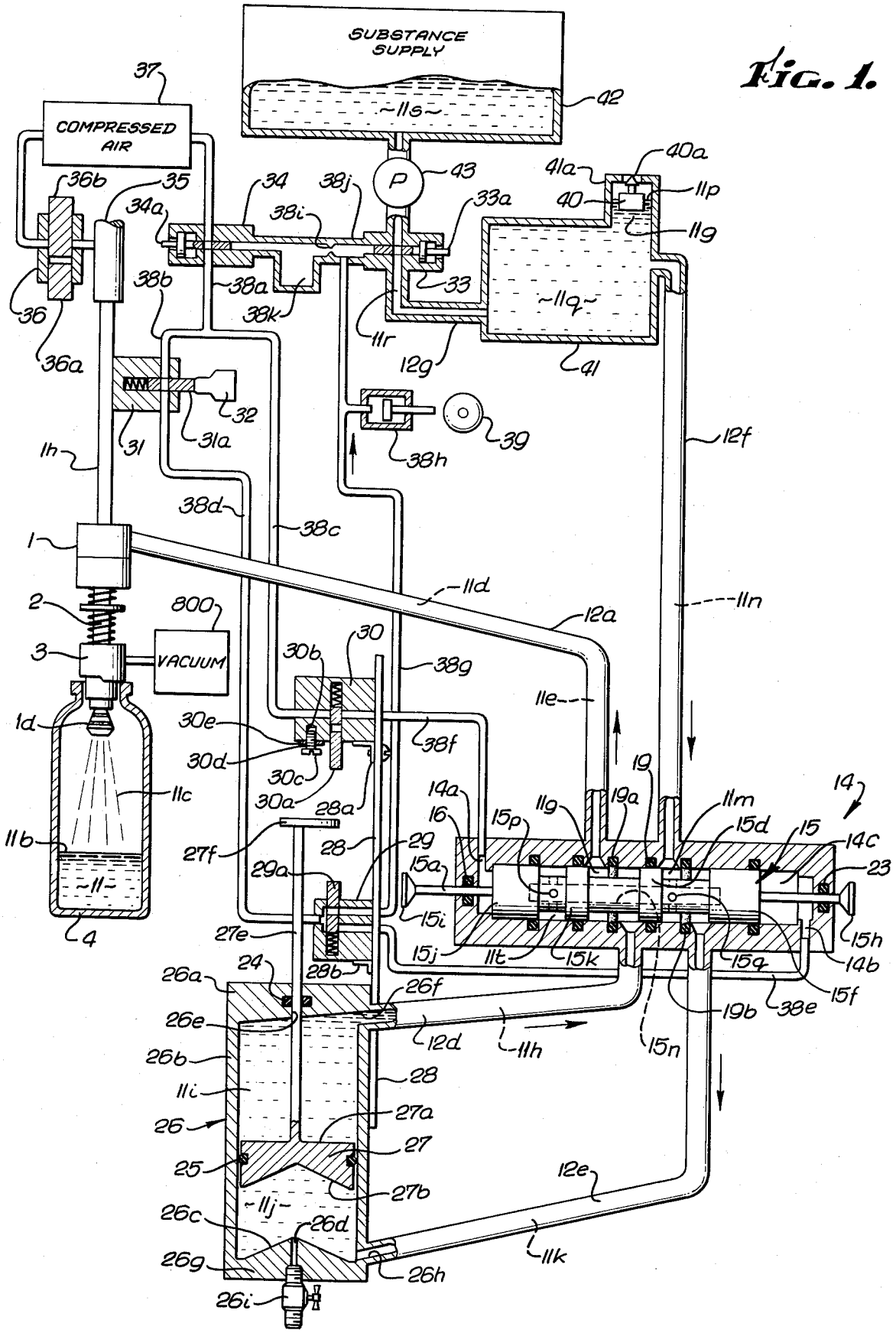
FIG. 1 is an elevation view, mostly in section, showing a dispensing system which is a preferred embodiment of the present invention, particularly one in which pneumatic valves are employed as sensors to control system sequencing.

It is to be understood that FIGS. 1 and 2 are somewhat schematic, in that the details of construction and assembly are not illustrated—the volumetric chamber, for example, being shown as a unitary block with a hollowed-out interior. In practice, of course, it would be impractical to make a structure in such a fashion, and virtually impossible to position the piston within such a structure, the chamber actually being made as a plurality of parts appropriately held together. One skilled in the art of mechanical design is able to provide such parts and fastenings on the basis of the schematic drawings herein.

FIG. 3 is a more realistic, construction-indicative view of alternative versions of the key features of the preferred embodiment shown in FIG. 1—in particular, the piston, piston rod, and upper limit switch and positive stop. FIG. 3 is an elevation, partly in cross-section.

DETAILED DESCRIPTION OF THE PREFERRED EMBODIMENTS

As shown in FIG. 1, the switch body 30 is provided with a tapped hole 30*b*, into which is threaded a screw 30*d* whose head forms a positive mechanical stop surface 30*c*. A lock-nut 30*e* on the screw 30*d* is used to cinch against the surface of the switch body 30, to prevent casual rotation of the screw 30*d*.

The switch button 30*a* in switch 30 functions as in my previous systems to transmit a reversing signal from pneumatic supply line 38*c* via line 38*f* to the spool valve 14; however, the stop surface 30*c* of the screw 30*d* now performs the function of halting the piston 27, so that relative adjustment of the reversing signal trigger point and positive stop is now possible.

For use with extremely viscous products, the stop surface 30*c* is adjusted so that the actuator 27*f* reaches the stop surface 30*c* at exactly the same time the actuator 27*f* depresses button 30*a* to the depth required to initiate the reversing signal. The system may be used set this way for less-viscous products, if desired, or alternatively the slight cushioning effect provided by a slightly early reversing signal can be exploited by screwing the screw 30*d* further into the switch body 30 or removing the screw 30*d* entirely.

It is highly advantageous to make the stop 30*c* and signal-generating switch 30, 30*a* adjustable in common with respect to the volumetric piston 27, as well as relatively adjustable with respect to each other—so that coarse or fine volume adjustments may be made by adjusting the stop 30*c* and switch 30, 30*a* together, once the type of product to be dispensed has been established and the stop 30*c* set accordingly. Otherwise it would be necessary to adjust both the stop 30*c* and switch 30*a* independently each time a trim adjustment of the volume dispensed was desired.

The common adjustment is illustrated, for the one-head system of FIG. 1, by securing the switch body 30 to a mounting member or bracket 28*a*, adjustably fixed with respect to the cylinder 26 by means of the intermediary plate 28, whose lower end is secured to the cylinder 26.

The actuator 27*f* is attached to piston rod 27*e*, which passes through the aperture 26*e* of the volumetric chamber top wall 26*a*, sealed by sliding seal 24. The lower end of the piston rod 27*e* is affixed to or integral with the piston 27, so that impingement of the actuator 27*f* upon positive mechanical stop surface 30*c* halts the piston 27. The piston 27 has a sliding seal 25 to isolate the part of the chamber above the piston from the part below while permitting motion of the piston vertically in the chamber. The under-surface 27*b* of the piston is concave as shown, to collect and trap bubbles of air or other gas which may be in the chamber 26 between the piston 27 and lower wall surface 26*c*.

The bottom internal end-wall 26*g* of the cylinder has a protrusion 26*c* which, when the piston 27 is at its lowest point, extends into the top of the concavity of the piston lower surface 27*b*. This protrusion may take any of a great variety of forms—for example, it may generally complement the shape of the piston under-surface 27*b* as shown. A duct 26*d* extends from outside the chamber to the top of the protrusion, and thus (when the piston is at the lowest extreme of its motion) to a position adjacent the top of the concave surface 27*b* of the piston. The outer end of the duct 26*d* should be suitably terminated, as for example by threading into the lower end-wall 26*g* from the outside a conventional valve 26*i* which may be opened to bleed off air from the concavity or closed for normal operation of the dispensing system.

In normal operation, substance 11*s* from the supply 42 passes pressure regulator 43 and incomplete-fill automatic shutdown valve 33, with reset button 33*a*, and tubulation 11*r*, to air de-entrainment vessel 41 which has a dome section 41*a* adapted to trap and accumulate air bubbles in the space above liquid level 11*p*. Liquid 11*q* within the dome section supports float 40 to engage valve 40*a* with its seat until the level 11*p* falls below a particular height, at which point excess air blows off at valve 40*a* permitting the float 40 and valve 40*a* to return upward to a closed condition.

Fluid with most of the entrained air removed proceeds at 12*f* into annular space 11*m* within spool valve 14. The fluid passes from annular void 11*m* via tube 12*e* into port section 26*h* of the metering chamber 26, raising the piston 27—which in turn impels fluid out of the chamber at 26*f* and via tube 12*d* to annular cavity 11*g* within the spool valve 14. Thence the fluid proceeds via tube 12*a* to the dispensing-nozzle assembly 1, 2 and 3.

As the piston 27 rises during this dispensing operation, rod 27*e* also rises, carrying actuating member 27*f* into contact with button 30*a* of pneumatic switch 30 and stop-surface 30*c*. As the actuating member 27*f* reaches the stop-surface it also triggers the pneumatic switch 30, permitting compressed air from supply 37 to flow by incomplete-fill automatic shut-down valve 34 (with reset button 34*a*) and via tubing 38*a* and 38*c* and the aforementioned valve 30 into tubing 38*f* and port 14*a* of the spool valve, impelling the spool 15 fully to the right (with respect to the illustration of FIG. 1) within the spool barrel, to a position which is not illustrated here. (That position is illustrated in FIG. 2*e* of my U.S. Pat. No. 4,095,628.)

In that rightward position, fluid entering from tube 12*f* flows via annular cavity 11*g* formed between lands 15*d* and 15*k* directly to tube 12*d*, reversing the direction of the metering piston so that the piston moves downward, propelling fluid outward via port 26*h* and tube 12*e* to annular space 11*m* formed between lands 15*d* and 15*f*, and thence to radial holes 15*q* into central bore 15*n* of the spool, then out through radial holes 15*p* into the annular space 11*t* between lands 15*j* and 15*k*, now aligned with tube 12*a*. Fluid then proceeds out through tube 12*a* to the dispensing assembly 1, 2 and 3 as is the case with the spool in the first position discussed.

In short, the spool valve reverses the connections to the metering cyclinder while preserving the directionality of fluid flow from supply to dispensing nozzle—in effect controlling the flow of fluid in two paths simultaneously.

As explained fully in my U.S. Pat. No. 3,870,089, element 32 of FIG. 2 is a CONTAINER READY cam which actuates button 31*a* of pneumatic switch 31 so that pneumatic selector switch 29 receives excitation pressure only when a container is ready to be filled—that is, when an empty container has been substituted for the preceding full one. If button 31*a* is depressed when the metering piston is not fully down, ready to begin a new fill, then pressure is applied through line 38*d* and pneumatic switch 29 to line 38*g*, which shuts down the fluid supply at switch 33, rings a bell 39 at actuator 38*h*, and then shuts down the air supply itself via pneumatic switch 34, actuated via a time-delay system composed of constriction 38*i* and pneumatic capacitive vessel 38*k*.

However, if button 31*a* is pressed after the piston has fully bottomed out, the pneumatic signal from switch 31 and line 38*d* is applied by switch 29 via line 38*e* and port 14*b* to return the spool 15 to its position illustrated in FIG. 1.

For schematic purposes, provision for raising and lowering of the dispensing assembly 1, 2 and 3 is represented by buttons 36*a* and 36*b* of switch 36, and the attached components. Button 36*a* of pneumatic switch 36 applies compressed-air pressure to air cylinder 35 to raise the dispensing assembly 1, 2 and 3 by means of support shaft 1*h*, to permit removal of the full container. Button 36*b* of switch 36 deactivates the air cylinder 35 so that the dispensing assembly can descend into the next container. In practice, automatic control (such as the cam described in my U.S. Pat. No. 3,870,089) of buttons 36*b* and 36*a*—or of the rod 1*h* mechanically—is more often used to raise and lower the dispensing assembly in synchronism with container feed and removal.

In any event when the dispensing assembly is lowered into and onto a waiting container, and the piston is waiting to begin a new stroke, the valve spool shifts back to its FIG. 1 position and a new filling cycle begins.

It is assumed here that the pneumatic signal previously applied to the spool at port 14*a* has (by the time the pneumatic signal is applied to the opposite end at port 14*b*) dissipated sufficiently to permit the spool to shift leftward. As is well-known to technicians skilled in the art, such dissipation must be allowed for in the design—either in the form of slow leaks at seal 16, or in the tubing connections; or in the form of a calibrated leak provided for this purpose. I prefer the last-mentioned approach, usually implemented by drilling a fine hole through the valve body or end plate. The same consideration of course applies to the next rightward shift, and needed dissipation from the area of port 14*b*.

Element 1 of FIG. 2 is a supply body, attached by internal centerpin to tip 1*d*. The supply body and tip coact with supply sleeve 2 and selectable orifices within the supply body and springs surrounding supply sleeve 2 to permit fluid flow at controlled rates from tube 12*a* into container 4 at 11*c*, providing a rising level 11*b* of fluid 11 in the container. Further, element 3 is a vacuum hood which draws off spray and droplets via a vacuum supply 800 and small conduits within tip 1*d*, under various conditions—all as detailed in my first above-mentioned patent.

Various alternative configurations of the spool valve 14 and the connecting tubulations 12*a*, 12*f*, 12*e* and 12*d* are discussed in detail in my U.S. Pat. No. 4,095,628.

The spool extensions 15*a* and 15*h* shown in FIGS. 2 through 2*e* hereof, and identified in FIG. 2, serve the same functions as described in my previous patent, namely to indicate externally the position of the spool within the valve barrel and to provide a means for breaking free the spool in the event that cold flow of the seals (when the machine is not operating) produces more static friction than can be overcome by operation of the pneumatic drive system. The shafts 15*a* and 15*h* are sealed at 16 and 23 respectively by compliant seals.

As noted earlier, it is not necessary for the bottom internal wall 26c of the chamber 26 to complement the shape of the under-surface 27b of the piston 27, so long as the air-bleed duct reaches to the top of the concavity in the under-surface 27b of the piston when the piston is at the bottom of its stroke. A great variety of configurations of the bottom internal wall 26c satisfy that constraint. For example, as illustrated in FIG. 2 the wall 126c may be substantially flat, but defining a generally vertical threaded hole 126d—through which is screwed a mating rod 51.

The rod 51 has external threads matching the internal threads of the hole 126d; advantageously has a set of flats 54 for adjustment by wrench or pliers from outside the chamber, and carries a lock-nut 56 which may be cinched against the outer surface of the chamber end-wall 126g to prevent casual rotation. The rod 51 of course defines a gas-bleeding duct 52 which extends from outside the chamber to a point which, when the piston is at the low extreme of its motion, is adjacent the top of the concave surface of the piston. The rod 51 also has external threads 55 for attachment of a sealing cap 57 to close the duct 52.

It is possible in principle to practice this part of my invention in conjunction with the internal-constriction antifoaming feature of my U.S. Pat. No. 4,095,628. The rod 51 may be made as an insert threaded through the center of the low-flowrate adjustment screw (57 in FIG. 2 of the patent) and through the central hole (52 in that figure) of the constricting washer (51 in that figure). The stiff spring (50 in that drawing) which supports the flow-constricting washer may be attached to the concave underside of the piston 27 without interfering with the function of the concavity in collecting gas bubbles.

However, with extremely viscous products the maximum dispensing speed is sufficiently slow that foaming is not usually a problem; therefore, the two-speed system of my U.S. Pat. No. 4,095,628 is not usually necessary.

FIG. 3 shows preferred embodiments of the present invention in a less-schematic way. As indicated, the piston, piston rod and actuator are not integrally constructed, but are separate parts permanently secured together. In particular, the piston rod 127e carries threads 127g and 127l on its upper and lower ends respectively. The rod also has turned-down end segments defining shoulders 127u and 127t at its upper and lower ends, respectively, for stabilizing the actuator plate 127f and piston 127.

At the lower end of the rod 127e its turned-down portion passes through a hole 127s defined in the piston body, and a nut 127m is screwed onto the threads 127l and cinched hard against the flat surface 127o at the end of the recess 127n. Thus the piston 127 is held between the flat 127t and the nut 127m. A like arrangement at the top of the rod 127e, though not cut away in the illustration, holds the actuator plate 127f firmly between shoulder 127u and nut 127h—the threaded or turned-down end segment of the rod passing through a tight-fitting hole (not shown) in the actuator 127f.

A small screw 127i is screwed into the end of the rod 127e, which is drilled and tapped for that purpose, and a lock-nut 127v cinches the screw 127i against the top end of the rod 127e to prevent casual rotation of the screw. The top surface 127k of the screw 127i engages the air button 130a at the top of the piston stroke; the bottom surface 127w of the actuator plate 127f engages the other air button (not shown here, 29a in FIG. 1) at the bottom of the piston stroke. Adjustment of the screw 127i in the end of the rod 127e thus offers one means of obtaining a trim adjustment of the stroke, and thus the volume dispensed.

The under-surface 127b of the piston 127 is concave as shown, terminating in a recess 127n for the retaining nut 127m; the recess is just large enough to permit installation of the nut 127m on the end of the rod, excess clearance being undesirable as it opens the way for an excess residual air bubble in the recess. An O-ring groove 127p is provided in the outer cylindrical surface of the piston 127; if desired, more than one such groove and O-ring may be provided. For strength, the extreme bottom end of the piston is an annular flat 127q, rather than a sharp edge, and all of the other corners 127 likewise are beveled, as indicated.

The pneumatic switch 130 is connected to an air-supply line 138c and a signal line 138f. When the button 130a is depressed to a certain point, the switch permits the compressed air from the supply line 138c to proceed into the signal line 138f, for the purposes previously described in relation to the correspondingly numbered components 38c and 38f of FIG. 1. However, the button 130a does not "bottom out" at that certain point, but rather at a deeper point of motion into the switch body 130. To achieve the synchronization described earlier, a stop-nut 130d is threaded onto the threaded end 130g of the switch body 130, to prevent the upper actuating surface 127k of the screw 127i on the piston rod 127e from advancing past the certain point at which the control signal arises. A lock-nut 130e also is threaded onto the threads 130g of the switch body 130, and cinched tightly against the stop-nut 130d to prevent casual rotation of the stop-nut. The lower surface 130c of the stop-nut 130d now engages the upper surface 127k of the screw 127i, acting as a positive mechanical stop to halt the upward motion of the piston.

Also threaded onto the threads 130g of the switch 130 is a retaining nut 130f, which grips a bracket 128a. The latter is held securely by screw 128b to a support 44. This support may be completely stationary, or, in the case of a multiple-head system such as described in my U.S. Pat. No. 3,870,089 may have analogous switches for the other heads mounted to it, and may be movable vertically to provide common volumetric adjustment of all the heads together. The action of plate 44 in providing this function may be seen in FIG. 3 of that patent, where the plate 44 is shown supporting switches 530, 630, 730, etc., and being vertically adjustable through a mechanism comprising elements 45 through 55, and 49a and 61, of that figure, and of course described in detail in that patent.

The support 44, bracket 128a and switch body 130 together form a mounting member adjustably fixed with respect to the cylinder. The button 130a and the operatively connected internal parts of the switch 130, along with the air lines 138f and 138c, form control-signal means carried on the mounting member for adjustment with respect to the piston, and adapted and operatively connected to respond to the piston by providing a signal to the control means (valve 14) to reverse the piston. The stop-nut 130d and in particular its end-surface 130c form a positive mechanical stop, also carried on the mounting member for adjustment in common with the mechanical stop, for halting the piston.

The threads 130g, mating internal threads of the stop-nut 130d, outer gripping surfaces of the stop-nut 130d, and lock-nut 130*e* form means, also carried on the mounting member (switch body 130) with the positive mechanical stop (130*c*) and control-signal means (130*a*), for effecting a relative adjustment of the positive mechanical stop and the control-signal means.

It remains only to describe the use of the present invention in bleeding off air from the concavity in the bottom of the piston. When the system (FIG. 1) is started up, bubbles of air or other gas may be created or be present in the supply 42, the regulator 43, the bubble trap 41, the valve 14, the volumetric cylinder 26, or any of the interconnecting tubing. Such bubbles will shortly migrate with the flow of product into the volumetric cylinder 26, if they do not start there. Bubbles entrained in the substance 11*i* in the top of the cylinder 26 are prevented from remaining there: the shaping of the upper internal end-wall 26*a* and the inclination of tubulation 12*d* tend to facilitate sweeping of the bubbles back out the tube 12*d*, through the valve 14 and the tube 12*a*, and forcibly out the nozzle 1, 2 and into a bottle 4.

However, bubbles arising or arriving in the substance 11*j* in the bottom of the cylinder 26 have a tendency to remain there, riding up and down with the piston 27. It will be recalled that in the system of my U.S. Pat. No. 3,870,089 provision was made for squeezing the bubbles out of that part of the chamber and into tubulation 12*e* for expulsion at the nozzle; but that such provision was discovered to be only partially effective in use with extremely viscous products. Thus smaller bubbles in that system tended to ride up and down with the piston and remain in the lower portion of the chamber—in an erratic and uncontrolled fashion, as described above. With the present invention, such bubbles are deliberately and systematically trapped and localized by the shape of the concavity 27*b*, to a region just corresponding with the top end of the duct 26*d*—and then are bled off from that region, through the duct.

After the system has been started up and operated through a few cycles so that the concavity has trapped as much of such air or other gas as there is to be trapped, the system is stopped with the piston at the bottom of its stroke. The valve 26*i* (or cap 57 in FIG. 2) is then opened, and the actuator 27*f* physically restrained by the operator (or by a suitable mechanical provision linked to the valve 26*i*) from rising; and the product feed is started again. The operator observes what issues from the open-air end of the valve 26*i* (or rod 51): at first a small amount of product, possibly left over from the previous batch of substance dispensed from the machine; and then air or other gas, as the pocket of such gas is forced by the rising product level within the concavity to escape through the duct. Eventually the operator will observe once again a flow of product from the valve 26*a* (or rod 51), and at that time will close the valve 26*i* (or halt the product feed and replace the cap 57).

Periodically the system can be stopped and this process repeated, with the operator noting the amount of gas found on each such occasion. In this way the operator can get a feeling for the frequency with which the process is needed—with the particular product and under the other conditions obtaining. In many cases the initial bleed after startup (or after each daily startup) will be found sufficient; on the other hand, relatively frequent bleed-off will be found necessary in certain cases—as, for example, with products subject to cavitation in the volumetric cylinder.

With respect to the language of certain of the appended claims, the following comment may be helpful.

The screw 127*i* is an extension of the piston rod 127*e*, and thus an extension of the piston 127 itself. Provided that the screw is not touching the switch button 130*a*, manipulation of the screw therefore changes the distance between the switch and the piston. Consequently it is correct to say that the adjustment screw 127*i* constitutes a means of obtaining adjustment of the pneumatic switch 130 with respect to the piston. This is true even though the bracket 128*a* which holds the pneumatic switch 130 may be nonadjustably stationary with respect to support 44, and the support 44 may be nonadjustably stationary with respect to the cylinder.

On the other hand, if the bracket 128*a* and support 44 are (as will more likely be the case) fixed adjustably with respect to the cylinder, then they provide additional, or other, means of adjustment of the pneumatic switch 130 with respect to the piston, wherever the piston may be with respect to the cylinder.

Thus the language "control signal means [e.g., button 130*a*] carried on the mounting member [e.g., bracket 128*a* and support 44] for adjustment with respect to the piston" is meant to describe either or both of two arrangements for providing stroke adjustment: (1) adjusting the effective length of the piston or cylinder, and (2) adjusting the switch position with respect to the cylinder.

It is also correct in either case to speak of the mounting member (130*g*, 130, 128*a*, 44) as fixed (whether or not adjustably) with respect to the cylinder.

It will be apparent that the details presented above are intended as merely illustrative, not as limiting the scope of my invention—which scope is intended to be determined by reference to the appended claims.

I claim:

1. A system for filling a container with flowable substance from a source thereof, comprising:

means defining a flow path for passage of such substance from such a source toward such a container;

a dispensing nozzle, connected to receive such substance from such source along the flow path, for discharging such substance into such container;

a volumetric cylinder connected along the flow path upstream of the nozzle, and a biacting piston within the cylinder, adapted to premeasure the volume of such substance discharged along the flow path from such source into such container;

control means, connected to control the direction of action of the piston;

a mounting member fixed with respect to the cylinder;

control-signal means, carried on the mounting member for adjustment with respect to the piston, and adapted and operatively connected to respond to the piston by providing a signal to the control means to reverse the piston;

a positive mechanical stop, also carried on the mounting member for adjustment in common with the control-signal means, for halting the piston; and means, also carried on the mounting member with the positive mechanical stop and control-signal means, for effecting a relative adjustment of the positive mechanical stop and the control-signal means.

2. The system of claim 1 wherein:

the control-signal means comprise a switch having:

a body, an actuating button which is retained by but spring-loaded outwardly along a line of motion with respect to the body and actuated by pressing it inwardly along the same line of motion; and threads defined by the body; and the positive mechanical stop comprises a threaded member secured to the body by means of said threads, by rotation of the member in a threading motion having a longitudinal axis; the longitudinal axis of the threading motion having a component parallel to the line of motion of the button.

3. The system of claim 2, wherein the mounting member is a bracket adapted to firmly hold the switch and adjustably secured with respect to the chamber.

4. The system of claim 2, also comprising a second positive mechanical stop fixed with respect to the cylinder, for halting the piston at the other end of its stroke from that at which the first-mentioned stop halts the piston; and wherein:

the mounting member is a bracket adapted to firmly hold the switch and secured with respect to the chamber; and means for adjusting the effective length of the piston as between its surfaces which engage the two positive mechanical stops respectively.

5. The system of claim 2 wherein the switch is pneumatic.

6. The system of claim 2, also comprising a threaded lock-member, operable on the threads of the aforesaid threaded member, for locking the said threaded member in position with respect to the body.

7. A system for filling containers with flowable substance from a source thereof, comprising:

structure defining a volumetric metering chamber having an inner cylindrical surface whose longitudinal axis is generally vertical, said surface terminating in a lower end wall;

a port defined by the chamber structure at the same end of the chamber as the said wall, and connected alternately to receive such substance from such a source and to discharge such substance to such containers;

a biacting metering piston positioned within the chamber, and adapted for motion therein toward and away from said lower end wall, to meter predetermined volumes of such substance into and out of the chamber via the port from such source and to such containers; and having a lower end surface facing said one end wall;

the lower end surface of the piston being concave, to trap at the top of the concave surface any gas bubbles which are between that surface and the end wall; and structure defining a sealable gas-bleed duct which extends from outside the chamber to a point which, when the piston is at the low extreme of its motion, is adjacent the top of the concave surface of the piston.

8. The system of claim 7 wherein:

the lower end wall of the chamber is convex, and has a protrusion to a point which, when the piston is at the low extreme of its motion, is adjacent the top of the concave surface of the piston; and the duct is defined in the protrusion.

9. The system of claim 8 wherein the end of the duct outside the chamber terminates in a valve.

10. The system of claim 7 wherein the duct-defining structure comprises:

a hole defined in the chamber end-wall; and a rod adjustably positioned in the hole, with one end of the rod inside the chamber, for longitudinal adjustment of the rod into and out of the chamber, the duct being defined in the rod; and the hole being so positioned and oriented and the rod being so dimensioned as to permit adjustment of the inner end of the rod adjacent the top of the concave surface of the piston, when the piston is at the lowest point of its motion.

11. The system of claim 10, wherein the hole and the rod are threaded together, and the rod is adjustable by screwing it partway into or out of the hole; and the rod carries a lock-nut adapted to be tightened against the chamber end-wall, to secure the adjustment, and a cap threaded over the end of the rod to seal the duct.

12. The system of claim 1, wherein:

the volumetric cylinder has an inner cylindrical surface whose longitudinal axis is generally vertical, said surface terminating in a lower end wall;

the biacting piston is adapted for motion within the cylinder toward and away from the lower end wall, and has a lower end surface facing the end wall;

the lower end surface of the piston is concave, to trap at the top of the concavity any gas bubbles which are between that surface and the end wall; and the system also comprises structure defining a sealable gas-bleed duct which extends from outside the chamber to a point which, when the piston is at the low extreme of its motion, is adjacent the top of the concave surface of the piston.

* * * * *